US005501330A

United States Patent [19]

Betts

[11] Patent Number: 5,501,330

[45] Date of Patent: Mar. 26, 1996

[54] PACKAGING OF HAND TOOLS

[76] Inventor: Geoffrey Betts, "Sunfield", High Street, Whitwell, near Worksop, England

[21] Appl. No.: 418,846

[22] Filed: Apr. 7, 1995

Related U.S. Application Data

[63] Continuation of Ser. No. 146,991, Nov. 2, 1993, abandoned.

[30] Foreign Application Priority Data

Nov. 4, 1992 [GB] United Kingdom ..... 9223112

[51] Int. Cl.[6] ..... B65D 85/20

[52] U.S. Cl. ..... 206/349; 206/480

[58] Field of Search ..... 206/349, 477, 206/480, 481, 483, 216, 372, 373

[56] References Cited

U.S. PATENT DOCUMENTS

| | | | |
|---|---|---|---|
| 2,161,854 | 6/1939 | Copell | 206/477 X |
| 3,067,866 | 12/1962 | Burton | 206/349 |
| 3,423,059 | 1/1969 | Kahn . | |
| 4,359,158 | 11/1982 | Gringer | 206/349 |
| 5,018,253 | 5/1991 | Oppenheimer | 206/480 X |

FOREIGN PATENT DOCUMENTS

| | | |
|---|---|---|
| 891414 | 12/1981 | Belgium . |
| 3123595 | 1/1983 | Germany . |

*Primary Examiner*—Jacob K. Ackun

*Attorney, Agent, or Firm*—Trexler, Bushnell, Giangiorgi & Blackstone, Ltd.

[57] ABSTRACT

A packaged point-of-sale item comprising a hand tool and a sheet of card to which it is secured by means comprising at least one bifurcated resilient clip, means securing the resilient clip to the sheet of card in a manner requiring damage of the card to detach it from the card, the clip being adapted, when detached from the card, for securement to a wall to act as a resilient clip for releasably holding the hand tool. The resilient clip may engage a neck portion of the hand tool so that, when forming part of the packaged point-of-sale item, the tool cannot be removed by sliding it through the clip.

17 Claims, 7 Drawing Sheets

PACKAGING OF HAND TOOLS

This application is continuation of application Ser. No. 08/146,991 filed Nov. 2, 1993, now abandoned.

FIELD OF THE INVENTION

The invention relates to the packaging and display of hand tools, particularly although not exclusively, of small tools such as screwdrivers and chisels. Throughout this specification, the term "hand tools" is to be taken to mean any tool used by hand, not only tools which might be used in a workshop but tools which are used in the kitchen for example, such as knives, whisks and the like.

It is becoming an increasingly more important requirement that packaging materials should be bio-degradable, that is to say, made of wood pulp product, for example of paper or cardboard, referred to hereinafter as "card", instead of plastics materials. If they include card and plastics materials in combination, the plastics component should be readily separable from the card.

There are various kinds of packaging devices in use at present which are made only partly of bio-degradable materials, for example having a card backing-sheet with an attached blister or a transparent plastics material for containing the packaged item. In such a case, only the card is bio-degradable.

It is another important requirement that packaged items for sale in shops and supermarkets should offer at least a minimum degree of difficulty to the removal of the item from its packaging so that the item concerned is not easily stolen. This is a requirement at least partly in conflict with the requirement that any plastics component of the packaging should be readily separable from any paper or card.

The object of the invention is to provide a method of and means for packaging a hand tool which will deter theft of the tool concerned whilst it is displayed for sale.

A further object of the invention is to arrange for at least some of the packaging material to be of use when the tool concerned is in use by a purchaser, this then providing an incentive to the separation of the card and plastics materials of the packaging when the packaged tool is first put to use.

SUMMARY OF THE INVENTION

According to one aspect of the invention, there is provided a packaged point-of-sale item comprising a hand tool and a sheet of card to which it is secured, and means securing said item to said sheet of card comprising at least one bifurcated resilient clip and the ends of legs of said clip having respective means, such as peg portions or barbs, by which the bifurcated clip is secured to the sheet of card in a manner requiring damage of the card to detach it, said bifurcated clip being adapted, when detached from the card, for securement to a wall to act as a resilient clip for releasably holding the hand tool. Preferably the resilient clip engages a neck portion of the hand tool, so that the tool cannot be removed by sliding it through the clip. The point-of-sale item may also include an elongate element of channel section and having interengagement means whereby the at least one bifurcated clip can be engaged therewith with its legs projecting therefrom. The interengagement means may comprise inwardly projecting rib portions of opposed side walls of the elongate element and with which grooves in side surfaces of the at least one bifurcated clip can be engaged.

The point-of-sale item may include a screwdriver and a sleeve device which, when the screwdriver is in use may project beyond the blade of the screwdriver to prevent the blade from slipping off a screw head. In this case, a visual indicator device connectable to the screwdriver for indicating the depth by which a screw has been inserted into a workpiece may comprise another bifurcated clip by means of which the screwdriver and sleeve device are secured to the sheet of card.

The sheet of card forming part of the packaged point-of-sale item may be printed on one side as a point-of-sale card and printed on the other side with information of use to a purchaser of the item concerned.

According to another aspect of the invention, there is provided packaging material for the packaging of a hand tool, said packaging material including a sheet of card to which the hand tool will be secured, and at least one bifurcated resilient clip the ends of the legs of which have respective means, such as peg portions or barbs, by which said bifurcated clip will be secured to said sheet of card in a manner requiring damage to the card to detach it, said bifurcated clip being adapted, when subsequently detached from said card, for securement to a wall to act as a resilient clip for releasably holding the hand tool.

DESCRIPTION OF THE PREFERRED EMBODIMENT

Figure 1:
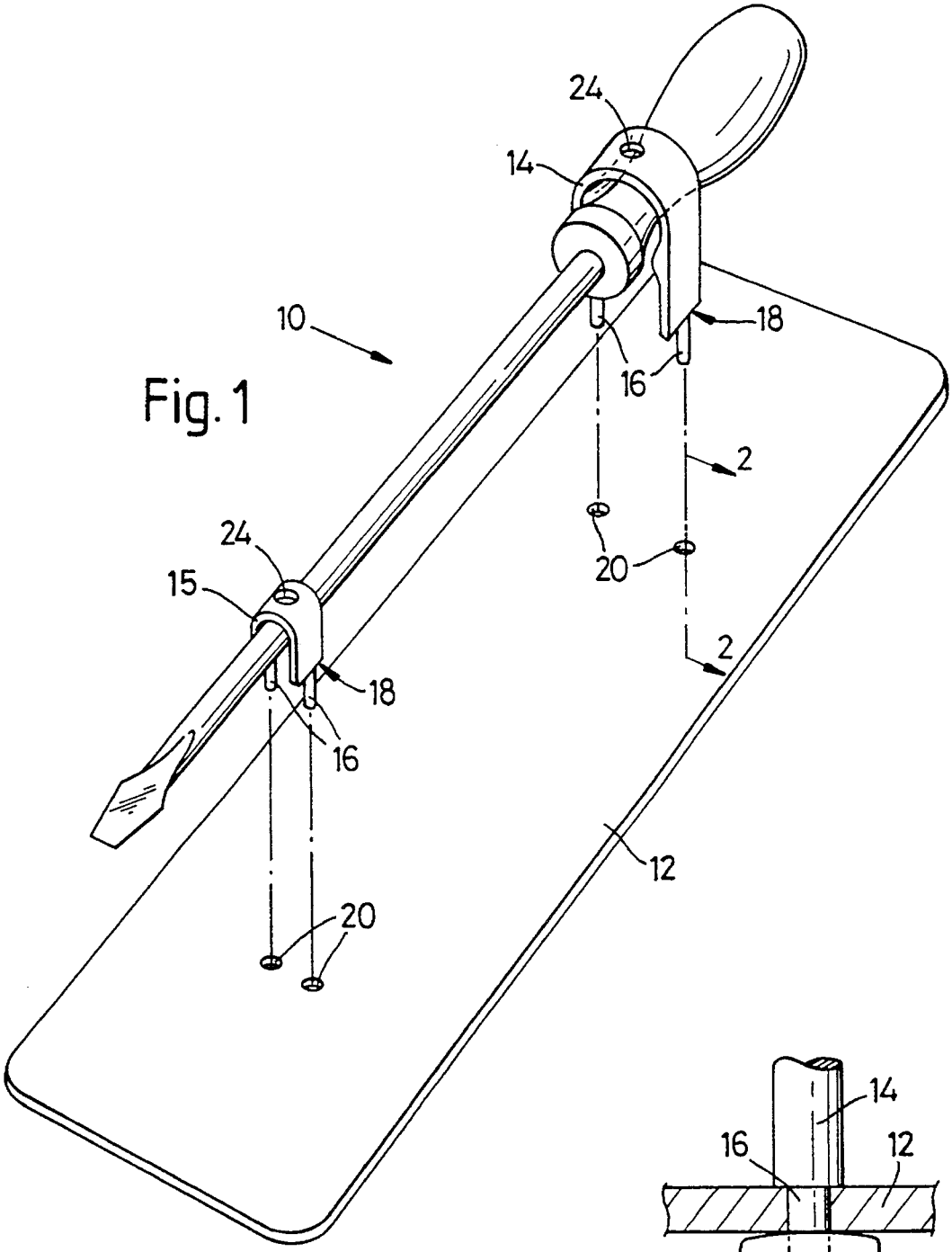
FIG. 1 is an exploded view of a screwdriver being packaged for sale by the inventive method.

Referring now to FIG. 1 of the drawings, the screwdriver 10 there illustrated is shown about to be secured to a sheet of card 12 so that it can be displayed for sale in a shop or supermarket.

Figure 2:
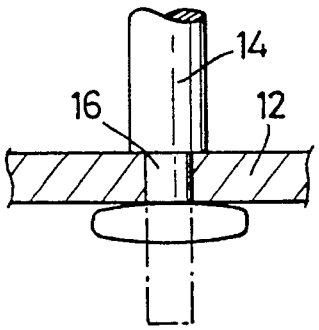
FIG. 2 is a scrap sectional view on the line 2—2 of FIG. 1.

A pair of plastics clips 14, 15 of bifurcated form are provided for securing the screwdriver to the sheet of card, the free ends of the legs of each clip being provided with respective peg portions 16 which project from respective shoulders 18. When said clips have been engaged with the screwdriver and the peg portions have been caused to extend through holes 20 in the card, a heating element (not shown) is used to deform the ends of said peg portions as indicated in FIG. 2, the amount of deformation being such that only by a determined effort can the clips be wrenched from the card, this being sufficient to deter the removal of the item concerned from the card whilst displayed for sale in a supermarket or shop.

Figure 3:
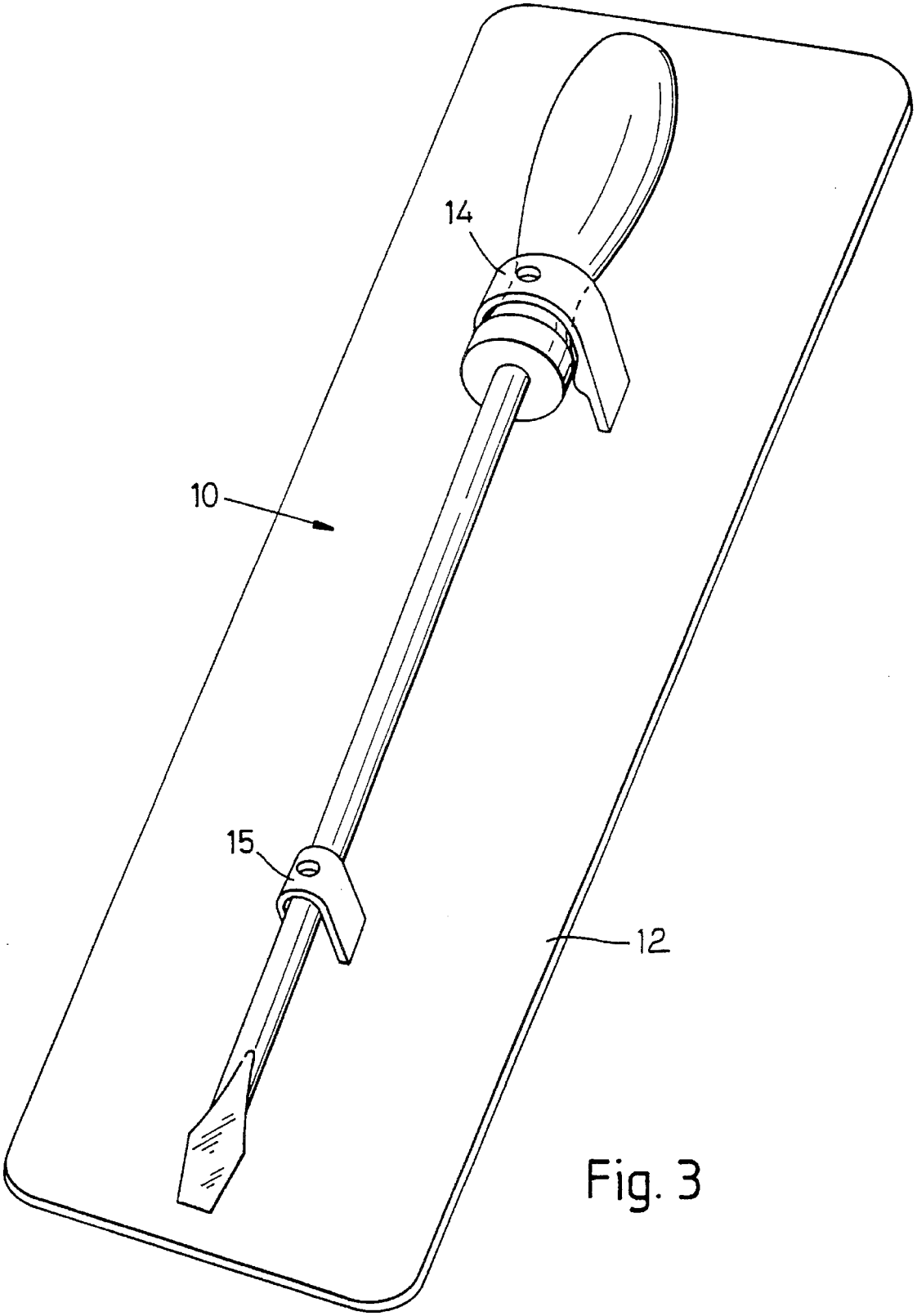
FIG. 3 is a view of the completed package.

The completed package is of a neat appearance, as shown in FIG. 3, and it will be understood that, because the clip 14 closely embraces a waisted portion of the screwdriver handle, the screwdriver is unable to be withdrawn from engagement with said clip. A potential purchaser of the screwdriver can, however, grasp the handle in order to test its "feel", that is to say to experience its touch.

Figure 4:
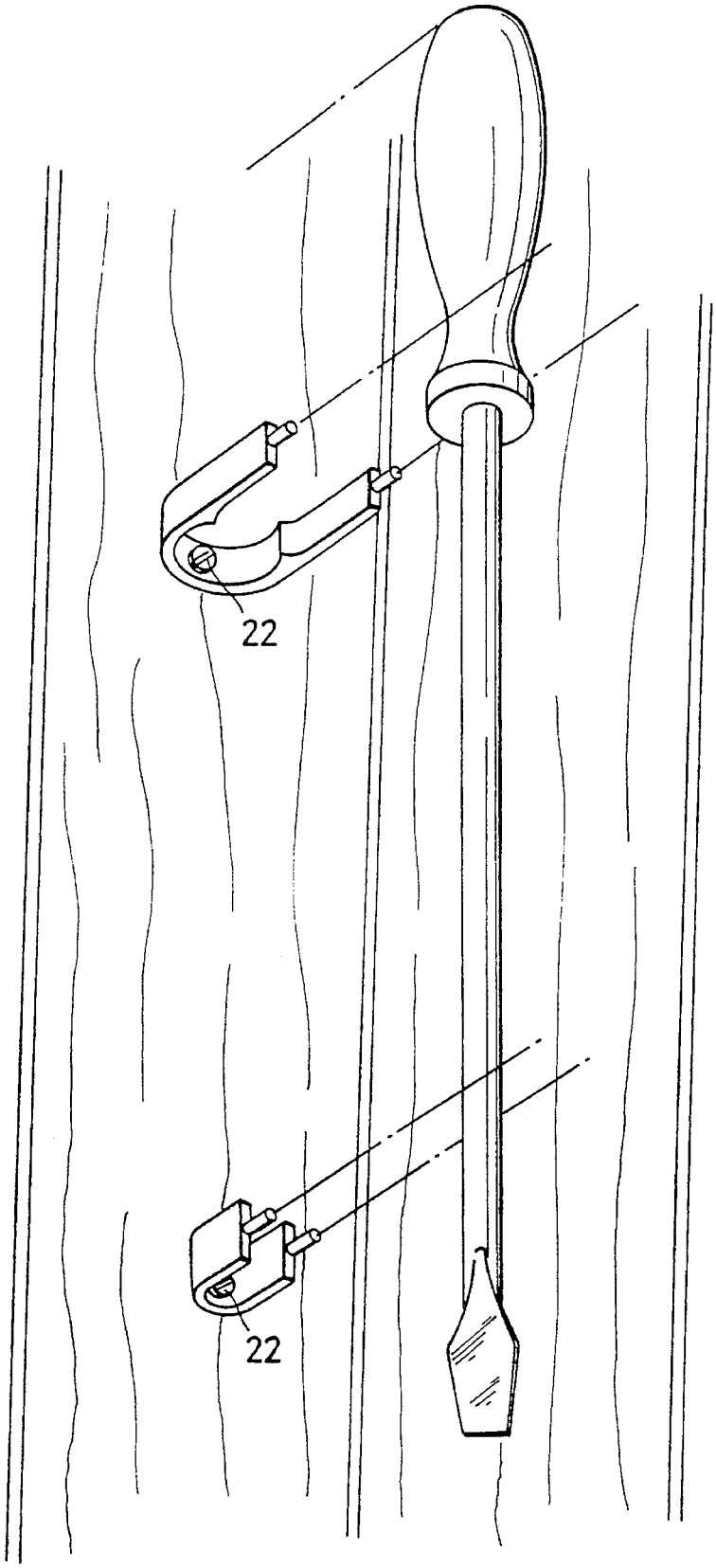
FIG. 4 is a view showing components of the package being re-used for presenting the screwdriver ready for use in a workshop or the like, and FIGS. 5 to 14 are views which illustrate possible modifications.

The arrangement is such that when a purchaser of the screwdriver has removed the clips 14, 15 from the card, at least the clips can be re-used, that is to say can be secured to a wall of a garage or workshop for example (to act as resilient clips for gripping the screwdriver when not in use) so that the only part of the packaging which needs to be disposed of is the sheet of card, and this is bio-degradable. In FIG. 4, the clips are shown to have been secured to a wall of a garage or workshop by means of respective screws 22 which have been passed through holes 24 in said clips. The remains of the peg portions 16 can of course be snapped off if desired but are shown in FIG. 4 to be still attached to the clips.

Various modifications may be made. For example, in FIG. 5 there is illustrated a packaged screwdriver assembly similar to that of FIG. 1 but including a length of generally channel section extruded aluminium 26. In the package assembly, respective peg portions of the plastic clip 15 extend through holes in the length of extruded metal section to secure it to the card. However, in this case, when the card has been disposed of, the length of extruded metal section can be secured to a garage or workshop wall by means of screws or nails passed through holes therein. The plastic clip 14 is in this case provided with grooves 28 in its side surfaces to enable it to be slid into position in engagement with inwardly projecting rib portions 30 of the opposed side walls of the extruded metal section.

This modification is particularly useful when a range of screwdrivers are to be presented for use side by side. It would therefore be most appropriate to supply the length of extruded metal section with such a range of screwdrivers, all being secured to a common card, as a point-of-sale presentation, in the manner described. A particular advantage of this method of securement is that as a screwdriver handle is forced between the projecting arms of its plastics clip 14, the deformation of the clip is such that it becomes wedged against sliding movement along the length of extruded channel section 26.

Figure 6:
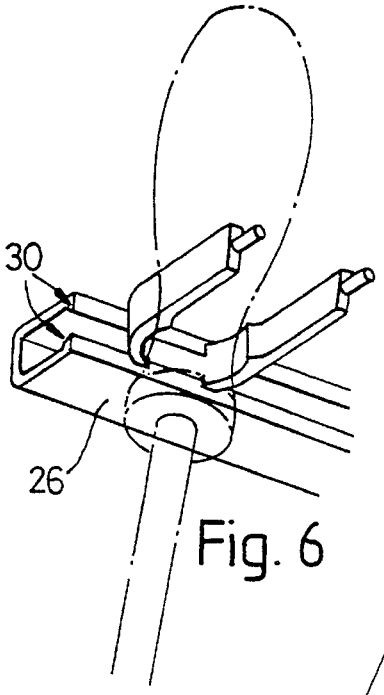
Figure 5:
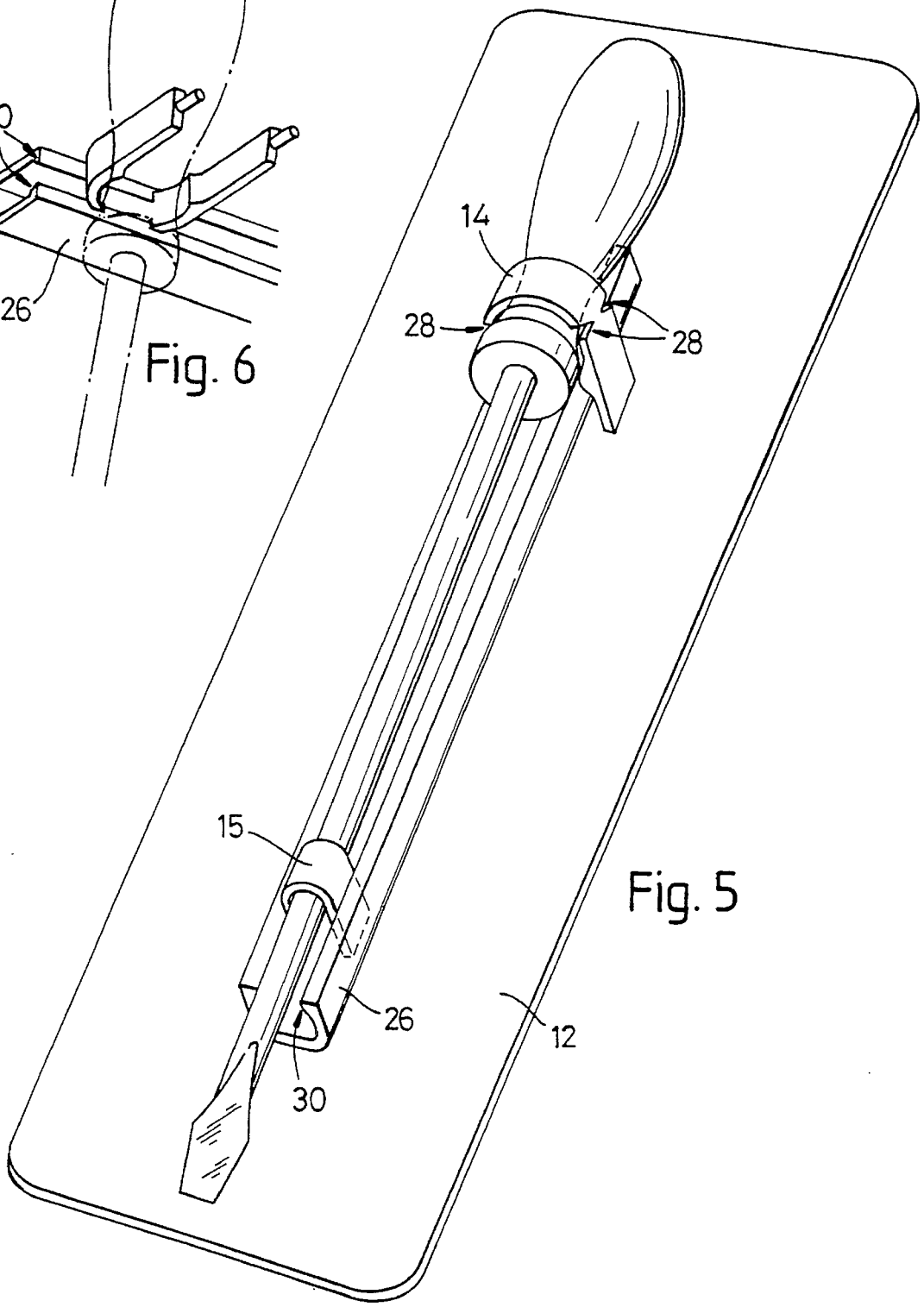
Figure 7:
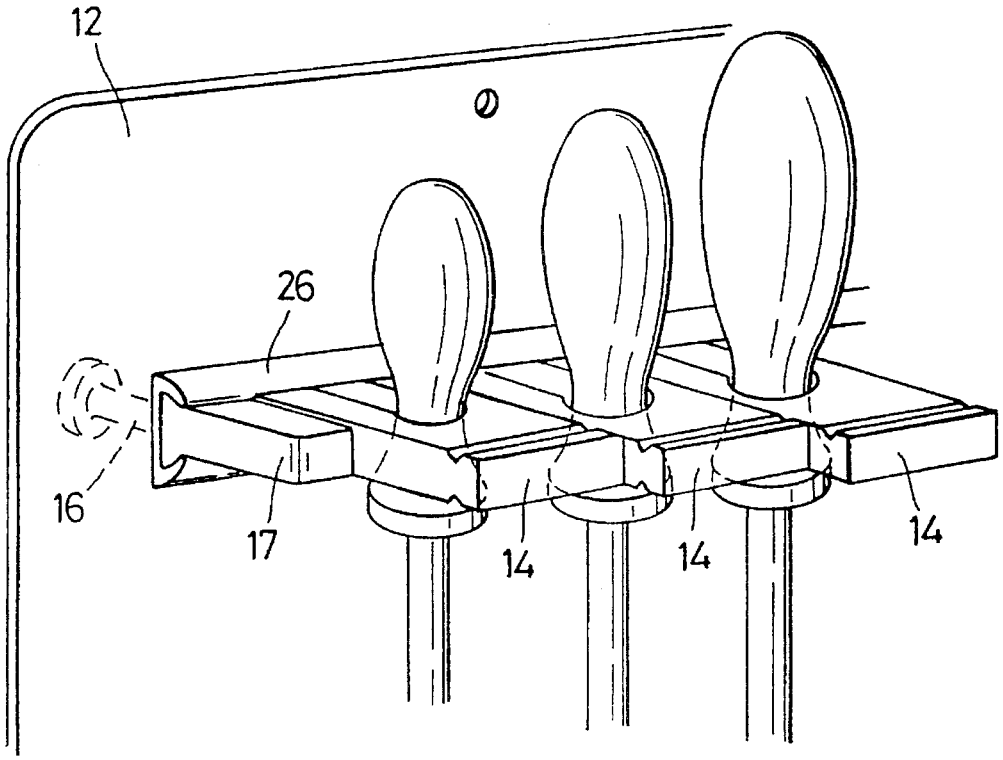
Figure 8:
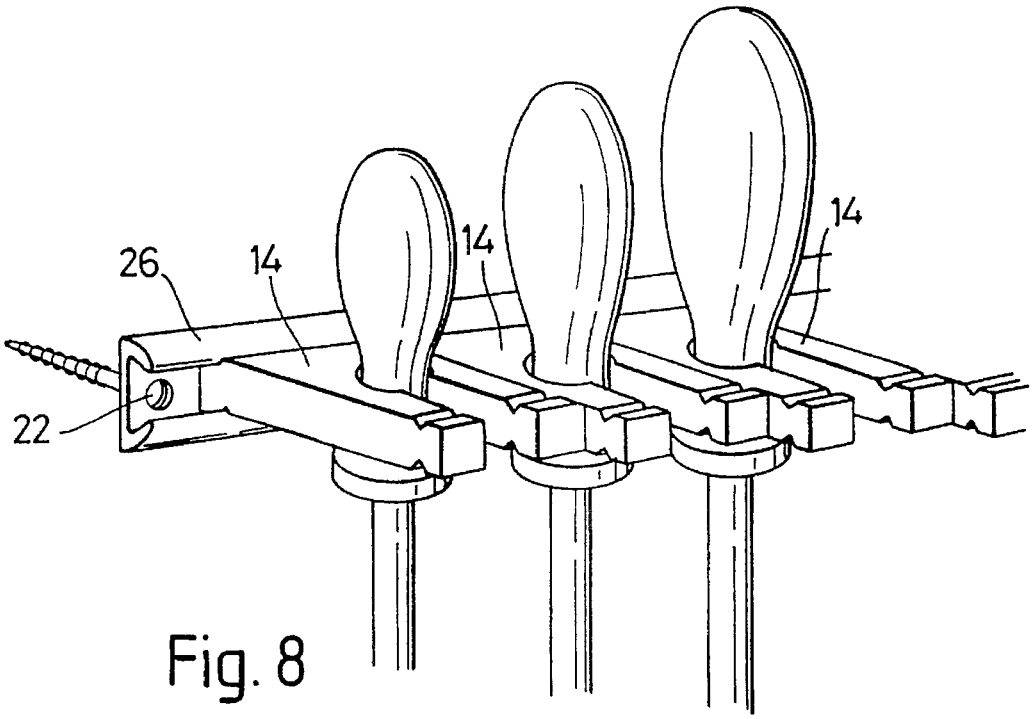

In FIGS. 7 and 8 there is illustrated a different embodiment including a length of generally channel section extruded aluminium 26 and a plurality of screwdrivers of varying sizes. As shown, the screwdrivers are located in position by respective plastics clips 14. However, in this case the plastics clips 14, which are grooved in similar fashion to those of FIGS. 5 and 6, are reversible in the length of channel section. Consequently, the packaged screwdrivers shown in FIG. 7 are captive in their inwardly facing respective clips 14 (since the clips encircle waisted portions of the screwdriver handles) and the clips are held captive in the length of channel section by plastics retaining elements 17 which abut against the endmost clips 14 (one only being shown in FIG. 7) to prevent the latter from being slid along the channel section. The retaining elements which also slidably engage the length of channel section have respective peg portions 16 which extend through holes in said channel section and in the sheet of card, the ends of said peg portions having either been deformed by a heating element or having been securely fixed in the card by some other means to necessitate the tearing of the card in order to release the useable parts from the sheet of card.

In FIG. 8, the sheet of card 12 and the retaining elements 17 are shown to have been discarded and the length of channel has been secured in position on a workshop wall or the like by screws 22. The respective clips 14 have been slid out of engagement with said length of channel and reversed so that each clip, having been-re-engaged with the length of channel, is outwardly facing. The screwdrivers can then be released from their respective clips at will.

It will be understood that in all the examples described above, not only is the or each plastics component readily separable from the card but the user has an incentive to separate the two because at least some of the plastics components are to be re-used. The card element may be the only part of the packaging which may be discarded and the packaging can thus be described as environmentally friendly. (In the examples illustrated in FIGS. 5 and 6, and in FIGS. 7 and 8, although certain plastics clips are not re-used they have to be removed from the sheet of card 12 in order to release the length of extruded aluminium section).

However, it may be that even the sheet of card 12 can be re-used by a purchaser of the screwdriver or set of screwdrivers or other hand tool, as the case may be. For example, one side of the card may be printed as a point-of-sale card but the other side of the card may be printed with information likely to be of use to the purchaser of the item concerned, for example with a chart of screw sizes or the like. In this case, the card, with the useful information presented for easy reference, may be secured to the garage or workshop wall in the same operation by which the bifurcated clip or clips is or are secured in position.

Figure 10:
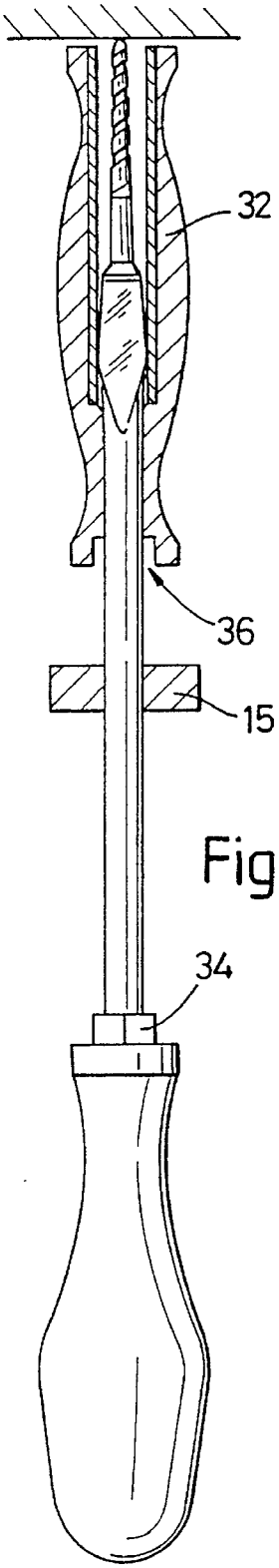
Figure 9:
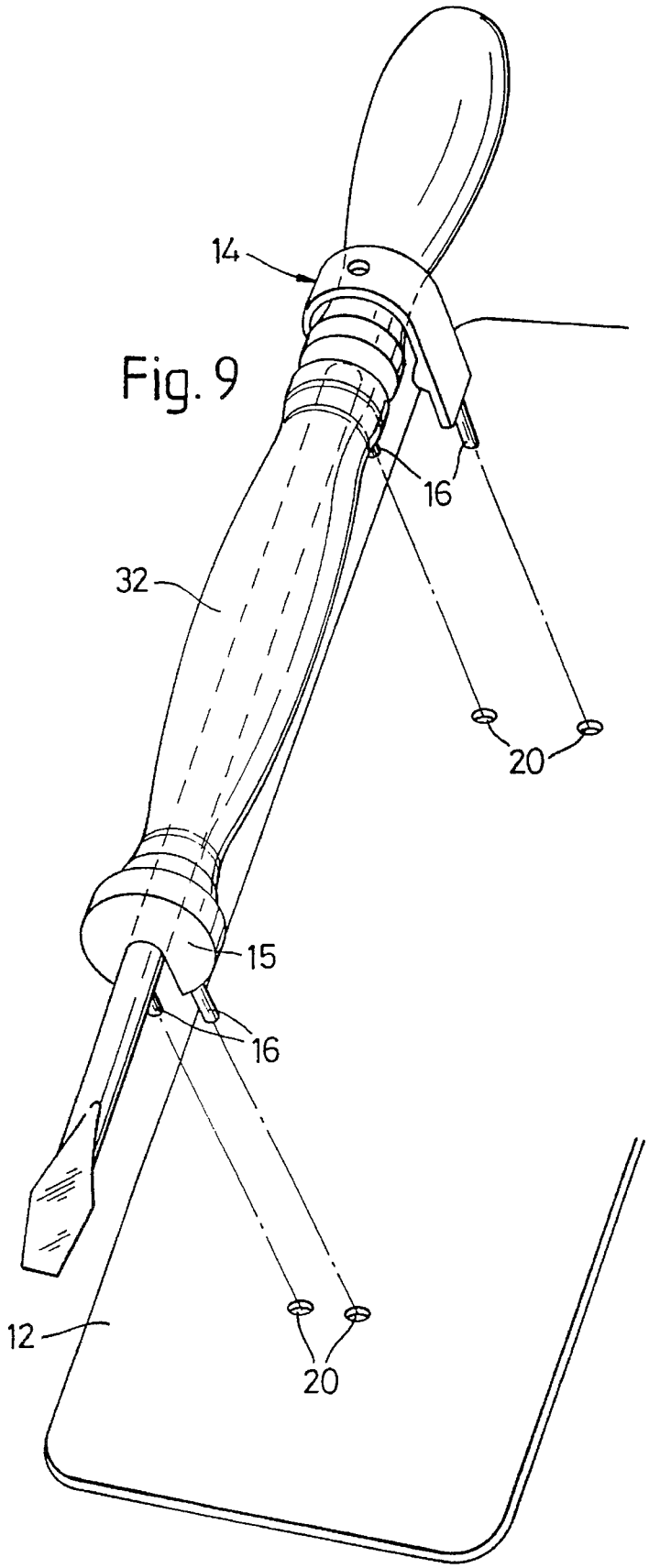

Referring now to FIG. 9, this illustrates the packaging of a screwdriver in a manner similar to that of FIG. 1 but the screwdriver is in this case provided with a sleeve device 32 which, when the screwdriver is in use, can be used in three different ways (as described in my co-pending application for patent filed concurrently herewith). In FIG. 10 the sleeve device is shown in use when starting a screw and in this position projects beyond the end of the blade of the screwdriver so that it prevents the blade from sliding sideways out of engagement with the slot in the screw head. (In an intermediate position of the sleeve device along the length of the cylindrical shaft portion of the screwdriver it can be held by the user to provide a steady for the screwdriver. In a third position of use, the sleeve device can be drivably engaged with the handle of the screwdriver, a hexagonal driving nut portion 34 beneath the head of the handle being engaged in a complementary socket part 36 of the sleeve device).

When being used in the manner illustrated in FIG. 10, it may sometimes be useful to have some visual indication of how far a screw has been driven into a workpiece. Such an indication is shown to be provided by the resilient clip 15, which has previously been used to secure the screwdriver to the sheet of card as shown in FIG. 9. The resilient clip can be snapped into position on the cylindrical shaft portion of the screwdriver, spaced from the rear end of the sleeve device by a distance roughly equal to the depth which it is desired to insert the screw. (The resilient clip 15 may also be used to provide a pre-determined degree of resistance to sliding of the sleeve device along the cylindrical shaft portion of the screwdriver).

Referring again to FIG. 9, in the packaging of the screwdriver and its associated sleeve device, the resilient clip 15 (shown in use in FIG. 10) comprises a slotted disc part with peg portions 16 which are to project through the holes 20 in the card before having their ends deformed by a heating element as previously described. When the screwdriver has been detached from its packaging, the remains of the peg portions 16 can be snapped off if desired.

Figure 11:
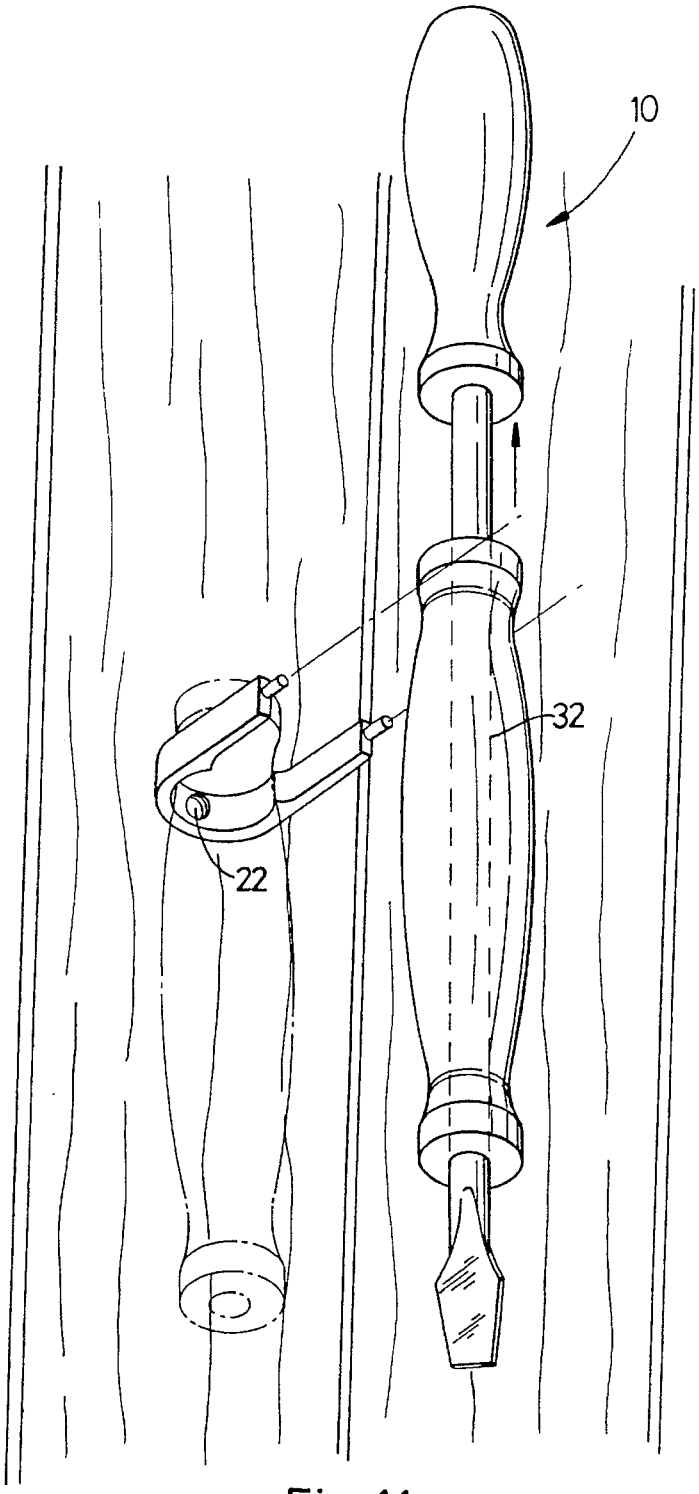

In this particular case, when the resilient clip 14 has been secured to a wall of a garage or workshop it can be used to retain the sleeve device as shown in FIG. 11. The screwdriver can then be located within the sleeve device and can be used with or without said sleeve device.

Figure 12:
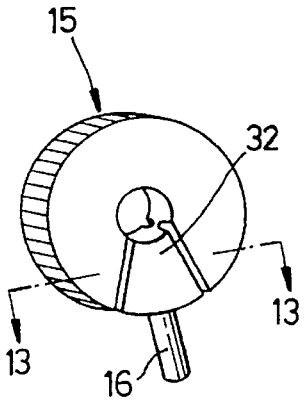
Figure 13:
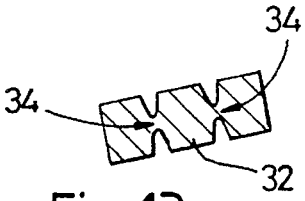
Figure 14:
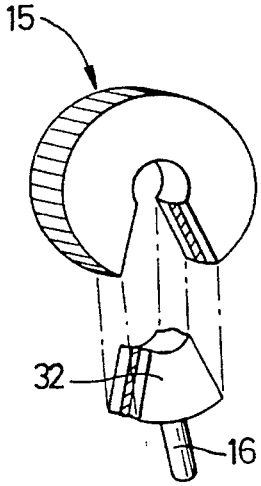

In FIGS. 12 to 14 there is illustrated an alternative method of forming the resilient clip 15, that is to say with a single peg portion 16 which when forming part of the point-of-sale package will extend through a hole in a sheet of card and have its end suitably deformed. As shown, the peg is formed integrally with a portion 32 of the clip which before use of the particular tool concerned can be broken away from the main body of the clip (see FIG. 14) by the tearing of frangible elements 34 and discarded, the main body portion of the clip then being useable with the tool in the manner hereinbefore described. It will be understood that the frangible elements 34 of the moulding by means of which the two portions of the clip are originally joined together (see FIGS. 12 and 13) will be sufficiently strong to defeat any attempt to separate them by hand but will be readily separable by the use of a pair of pincers or the like when the tool concerned is first being put to use by a purchaser.

It will be understood that the resilient clip 14 could be formed in a similar fashion, that is to say with a main body portion originally connected to a portion which will subsequently be discarded by means of frangible elements.

Various other modifications may be made. For example, it is not essential for the plastics clips to be secured to the sheet of card in the manner described, that is to say by the use of a heating element to deform the ends of the pegs; said pegs could be replaced by respective barb elements which are an interference fit in the holes in the card.

The invention is applicable to the packaging of various hand tools of the kind which may be mounted on a workshop or garage wall for example for convenient use. However, the hand tools concerned need not necessarily be workmens tools. They could comprise, for example, kitchen utensils such as knives, whisks, etc.

What I claim is:

1. A packaged point-of-sale item comprising a hand tool and a sheet of card to which it is secured by at least one bifurcated resilient clip having a pair of legs and a hole through a part of said clip joining said legs, said the resilient clip surrounding a neck portion of the hand tool and the legs of the clip being secured at respective extremities thereof to the sheet of card in a manner requiring damage of the card to detach it from the card, so that when forming part of the packaged point-of-sale item the tool cannot be removed from the card by sliding it through the clip and so that, when subsequently detached from the card and from the tool, the clip is securable to a wall by securing means extending from the wall through the clip hole whereby said legs project from the wall to act as a resilient clip for releasably holding the hand tool thereon.

2. A packaged point-of-sale item as claimed in claim 1, including an elongate element of channel section and having interengagement means whereby the at least one bifurcated clip can be engaged therewith with its legs projecting therefrom.

3. A packaged-point-of-sale item as claimed in claim 2, in which the interengagement means comprises inwardly projecting rib portions of opposed side walls of the elongate element with which grooves in side surfaces of the at least one bifurcated clip can be engaged.

4. A packaged point-of-sale item as claimed in claim 1, including a screwdriver and a sleeve device which, when the screwdriver is in use, may project beyond the blade of the screwdriver to prevent the blade from slipping off a screw head.

5. A packaged point-of-sale item as claimed in claim 4, in which a visual indicator device, connectable to the screwdriver for indicating the depth by which a screw has been inserted into a workpiece, comprises another bifurcated clip by means of which the screwdriver and sleeve device are secured to the sheet of card.

6. A packaged point-of-sale item as claimed in claim 1, in which the sheet of card forming part of said item is printed on one side as a point-of-sale card and printed on the other side with information of use to a purchaser of the item concerned.

7. Packaging material for the packaging of a hand tool, said packaging material including a sheet of card to which the hand tool will be secured, and at least one bifurcated resilient clip having a pair of legs and ends thereof of which have respective means by which said bifurcated clip further having a hole through a portion of said clip joining said legs and will be secured to said sheet of card in a manner requiring damage to the card to detach it, said bifurcated clip being securable, when subsequently detached from said card, to a wall by securing means extending from the wall through the clip hole whereby said legs project from the wall to act as a resilient clip for releasably holding the hand tool thereon.

8. A packaged point-of-sale item comprising a hand tool and a sheet of card to which it is secured by at least one bifurcated clip having a pair of legs and securement means at a part of said clip joining said legs whereby it can be secured to a wall, said resilient clip surrounding a neck portion of the hand tool and the legs of the clip being secured at respective extremities thereof to the sheet of card in a manner requiring damage of the card to detach it from the card, so that when forming part of the packaged point-of-sale item the tool cannot be removed from the card by sliding it through the clip and so that, when subsequently detached from the card and from the tool, the clip is securable to a wall in a manner whereby its legs project form the wall to act as a resilient clip for releasably holding the hand tool thereon.

9. A packaged point-of-sale item as claimed in claim 8, in which the securement means whereby said bifurcated clip can be secured to a wall are constituted by a hole through a part of said clip joining the legs of said clip, so that, when subsequently detached from the card and from the tool, when subsequently detached from the card and from the tool, the clip is securable to a wall by securing means extending from the wall through the clip hole whereby said legs project from the wall.

10. A packaged point-of-sale item as claimed in claim 8, in which the securement means whereby said bifurcated clip can be secured to a wall includes an elongate element of channel section itself securable to a wall and having interengagement means whereby said bifurcated clip can be subsequently engaged therewith with its legs projecting therefrom so that, when said elongate element has been detached from the card and said at least one bifurcated clip has been detached from the card and from the tool, the elongate element can be secured to a wall and the clip can be secured to said elongate element by said interengagement means whereby the legs of said clip project from the wall.

11. A packaged point-of-sale item as claimed in claim 10, in which the interengagement means comprise inwardly projecting rib portions of opposed side walls of the elongate element with which grooves in side surfaces of said bifurcated clip can be engaged.

12. A packaged point-of-sale item as claimed in claim 8, including a screwdriver and a sleeve device which, when the screwdriver is in use, may project beyond the blade of the screwdriver to prevent the blade from slipping off a screw head.

13. A packaged point-of-sale item as claimed in claim 12, including a bifurcated resilient clip which, when detached from the card and from the screwdriver, is subsequently reconnectable to the screwdriver for indicating the depth by which a screw has been inserted into a workpiece.

14. A packaged point-of-sale item as claimed in claim 8, in which the sheet of card is printed on one side as a point-of-sale card and printed on the other side with information of use to a purchaser of the item concerned.

15. Packaging material for the packaging of a hand tool, said packaging material including a sheet of card to which the hand tool will be secured, and at least one bifurcated resilient clip having a pair of legs the ends thereof each of which have respective means by which said bifurcated clip will be secured to said sheet of card in a manner requiring damage to the card to detach it, said clip further having securement means at a part of said clip joining said legs to be securable to a wall with its legs projecting therefrom to act as a resilient clip for releasably holding the hand tool thereon.

16. Packaging material as claimed in claim 15, in which the securement means at the part of the clip joining the pair of legs are constituted by a hole through which securing means extending from a wall can extend to secure the clip in position with its legs projecting from the wall.

17. Packaging material as claimed in claim 15, including an elongate element of channel section adapted to be secured to a wall, and the securement means at the part of the clip joining the pair of legs being constituted by interengagement means whereby said clip can be engaged with said element of channel section to secure the clip in position with its legs projecting from the wall.

* * * * *